US007216400B2

(12) United States Patent
Hodson

(10) Patent No.: US 7,216,400 B2
(45) Date of Patent: May 15, 2007

(54) DOOR HOLD AND RELEASE MECHANISM

(76) Inventor: Ernest F. Hodson, 387 Moose Hill Rd., Monroe, CT (US) 06468

( * ) Notice: Subject to any disclaimer, the term of this patent is extended or adjusted under 35 U.S.C. 154(b) by 0 days.

(21) Appl. No.: 10/459,326

(22) Filed: Jun. 10, 2003

(65) Prior Publication Data

US 2003/0226235 A1 Dec. 11, 2003

Related U.S. Application Data

(60) Provisional application No. 60/387,790, filed on Jun. 11, 2002.

(51) Int. Cl.
*E05F 3/00* (2006.01)

(52) U.S. Cl. ..... 16/66; 16/DIG. 17

(58) Field of Classification Search ..... 16/66, 16/49, 67, 68, 70, 84, DIG. 9, DIG. 17
See application file for complete search history.

(56) References Cited

U.S. PATENT DOCUMENTS 4,194,264 A * 3/1980 Stoffregen ..... 16/52
4,639,969 A * 2/1987 Obenshain ..... 16/70
4,815,163 A * 3/1989 Simmons ..... 16/49
5,048,150 A * 9/1991 Guerin ..... 16/49
D356,938 S * 4/1995 Duffy ..... D8/343
5,529,148 A * 6/1996 O'Leary ..... 188/67
5,592,780 A * 1/1997 Checkovich ..... 49/386
5,659,925 A * 8/1997 Patterson ..... 16/82
5,832,562 A * 11/1998 Luca ..... 16/71

* cited by examiner

*Primary Examiner*—Suzanne Dino Barrett
*Assistant Examiner*—Mark Williams
(74) *Attorney, Agent, or Firm*—John R. Doherty

(57) ABSTRACT

A door hold and release mechanism is provided including a housing mounted onto the pneumatic cylinder of a door check or closer having a piston rod extending from one end of the cylinder. The piston rod passes through an oversized hole in a drop stop which restricts movement of the piston rod when the drop stop is tilted. A cap button is mounted on top of the housing and is connected to one end of an elongated shaft disposed in the housing. A spring exerts a bias pressure on the shaft which opposes the external force applied to the shaft when the cap button is depressed. A draw bar extends outwardly through the housing and is connected at one end to the drop stop. A cam action linkage connects the other end of the draw bar to the opposite end of the shaft. The linkage includes an elongated cam slot formed within the end of the shaft and a pin which extends through the slot and the rearward end of the draw bar. The slot is inclined at an angle such that the draw bar is forced to move laterally and rearwardly in response to the external force applied to the shaft. This action causes the drop stop to tilt and engage the piston rod thereby holding the door open for passage of the operator.

16 Claims, 3 Drawing Sheets

DOOR HOLD AND RELEASE MECHANISM

This application claims the benefit of Provisional Application No. 60/387,790 filed Jun. 11, 2002.

BACKGROUND OF THE INVENTION

1. Field of the Invention

This invention relates a new and improved door hold and release mechanism for use with conventional reciprocating pneumatic operated door checks or closers known in the art.

2. Description of the Prior Art

Door-checks or closers, as they are often referred to, such as the reciprocating pneumatic cylinder type used on storm, screen and similar type doors, automatically close the door after the door has been opened and then released. The door must be hand or mechanically held open while passing through or invariably the door will automatically return, possibly causing injury to the person passing through the doorway.

In order to hold a door open, while passing through a door equipped with the typical reciprocal door-check used on a majority of storm and screen door installations, it is necessary to first slide a "lock tab", located on the door-check's piston rod, toward and into contact with the face of the door-check cylinder. This requires holding the door in an open position with one hand while sliding the lock-tab with the other, and then reversing the procedure to allow the door to close under action of the cylinder.

This two-fold operation is both clumsy and time consuming. Additionally, since sliding the lock-tab can only be done from inside the door, the prior art is only useful under circumstances where a person is leaving and then immediately returning through the door. Moreover, a dangerous scenario posed by the sliding lock-tab is that because of its operational difficulty, a person might decide not to use its hold-open function and proceed to pass through the door while the door is automatically returning to its closed position, resulting in injury. Further, in those cases where the door checks are installed on the lower portion of a door requiring bending down to operate the lock-tab, the operator is in a more precarious position for injury should the door check malfunction.

It is therefore a primary object of the invention to provide a door hold and release mechanism which is able to hold a door open, hands free, until the person opening the door has completely passed through the door and then subsequently release the hold on the door and allow it to close safely.

Another object of the invention is to provide a door hold and release mechanism which can restrain a door in an open position by the simple action of depressing a button, either by hand or foot, and releasing the restraint by a simple outward pressure on the door.

Still another object of the invention is to provide a door hold and release mechanism which is small and easily mounted onto a door check cylinder, which has a minimum number of moving parts and which is easily manufactured.

Yet another object of the invention is to provide a door hold and release mechanism which is adaptable to most, if not all, reciprocal pneumatic door-checks or closers of the type often used on conventional screen and storm doors.

SUMMARY OF THE INVENTION

According to the invention, there is provided an improved door hold and release mechanism for use with a door-check or closer of the type including a pneumatic cylinder and a reciprocating piston rod. The door hold and release mechanism of the invention includes a housing mounted onto the side wall of the pneumatic cylinder and a drop stop fitted over the piston rod close to one end of the cylinder. The piston rod passes through a hole in the drop stop which is of such size as to allow movement of the piston rod through the hole in a first position when the drop stop is substantially perpendicular to the piston rod but which restricts movement of the piston rod by friction in a second position when the drop stop is tilted at an angle other than perpendicular to the piston rod.

A cap button is mounted on top of the housing and is used to activate the door hold and release mechanism by depressing the button using a person's hand or foot, for example. An elongated shaft is disposed in the housing and is connected at one end to the cap button. A spring mounted inside the housing exerts a bias pressure on the shaft which opposes the external force applied to the shaft when cap button is depressed.

A draw bar is also mounted within the housing and has a forward end extending outwardly through the housing which is connected to the drop stop. A cam action linkage connects the other rearward end of the draw bar to the opposite end of the shaft. The linkage comprises an elongated cam slot formed within the opposite end of the shaft and a pin, which extends through both the slot and the rearward end of the draw bar. The slot is inclined at an angle with respect to the draw bar such that the draw bar is forced to move both laterally along with the shaft and in a rearward direction in response to the external forces applied to the shaft when the cap button is depressed. This in turn causes the drop stop to tilt from its first position perpendicular to the piston rod to its second position engaging the piston rod and holding the door open for passage of the operator.

DESCRIPTION OF A PREFERRED EMBODIMENT

Figure 1:
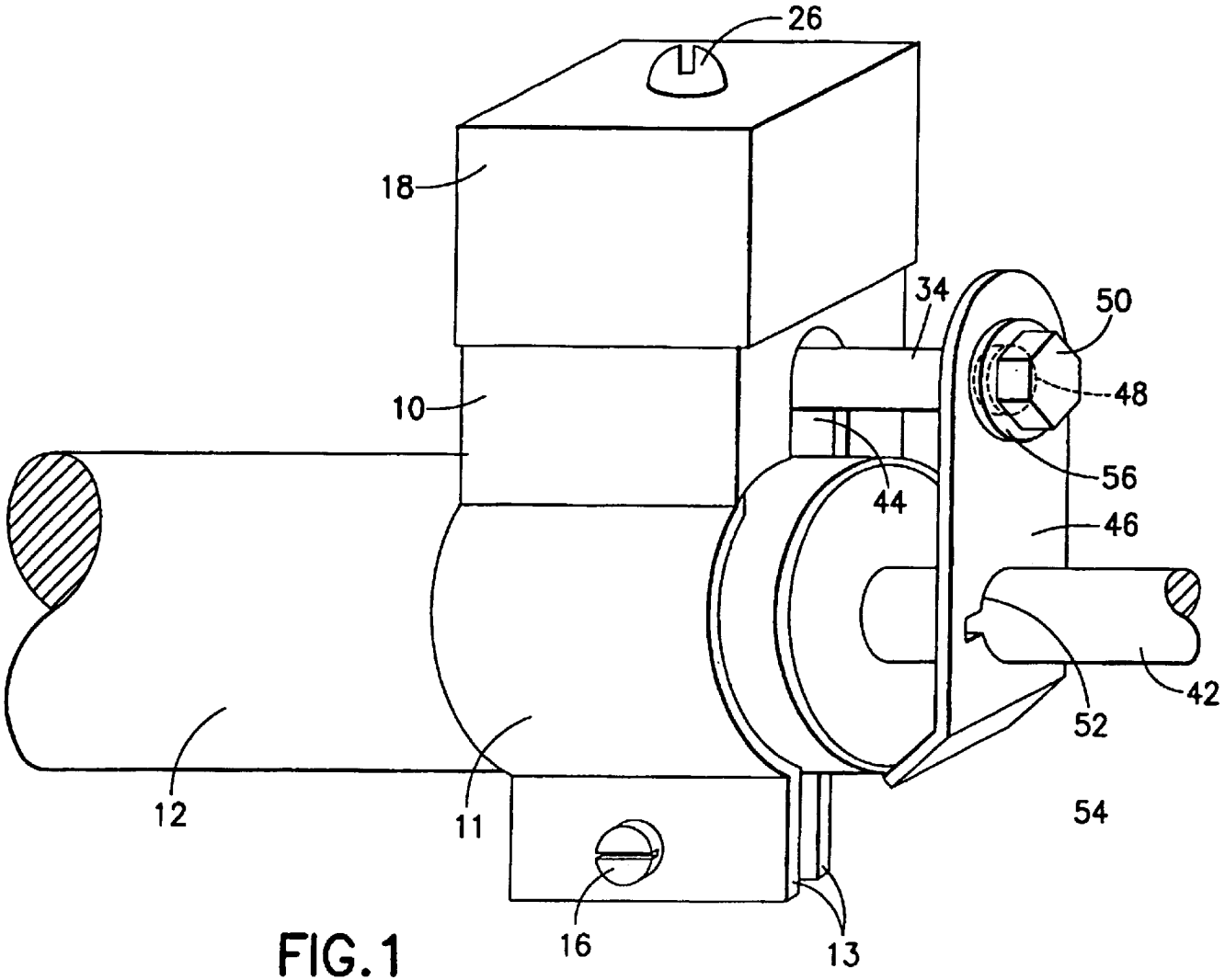
FIG. 1 is a perspective view of a door hold and release mechanism of the invention shown mounted onto the pneumatic operated cylinder of a conventional door-check or closer.
Figure 2:
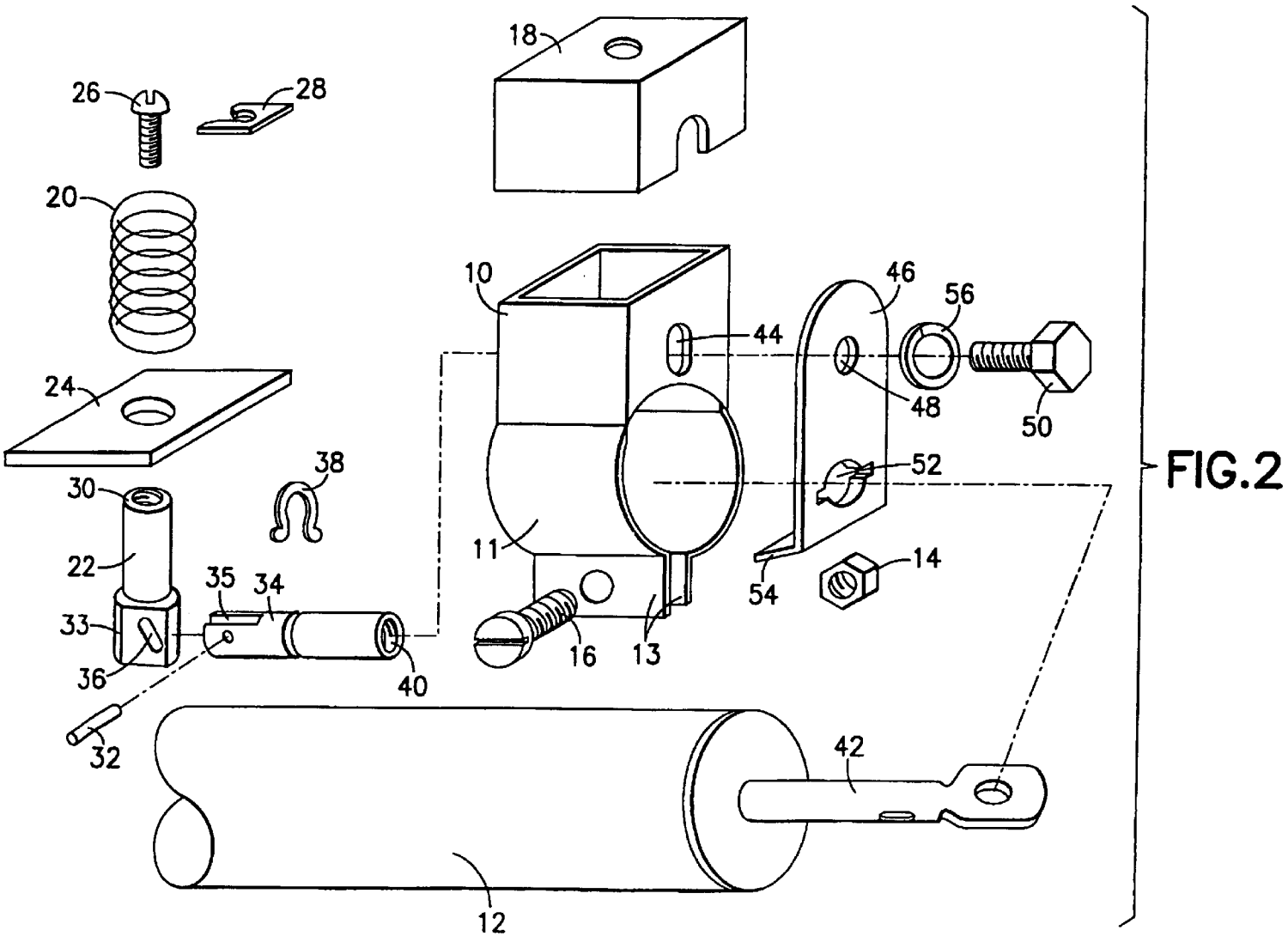
FIG. 2 is an exploded view of the door hold and release mechanism and pneumatic operated door check shown in FIG. 1.

Referring now to the drawings and particularly to FIGS. 1 and 2, there is shown a door hold and release mechanism embodying the invention. As shown, the mechanism includes a housing 10 of a generally rectangular shape attached to the pneumatic cylinder 12 of a conventional door check using a mounting sleeve 11. The sleeve 11 is of such size as to fit easily around the side walls of the cylinder 12 and is split and formed with a pair of opposed fastening tabs 13. The tabs 13 allow the sleeve 11 to be tightened securely around the cylinder 12 using a bolt 16 an a nut 14. This arrangement permits the housing 10 to be mounted to a variety pneumatic cylinders 12 having varying diameters as may be produced by different manufacturers. It is of course possible to dispense with the sleeve **10*a* altogether and secure the housing 10 directly to the pneumatic cylinder 12**, thus utilizing the mechanism as an integral part of a door check design.

Although the door hold and release mechanism of the invention is shown in the drawings as being mounted in a vertical position on top of the pneumatic cylinder 12, it will be understood that the mechanism may be mounted as well horizontally to one side of the cylinder, this arrangement being preferred in those cases where the mechanism is secured to the door mid-way between its top and bottom ends. In this particular arrangement, the mechanism can be more easily activated by the person's hand, arm or elbow when carrying a child or groceries, for example, as opposed to using a foot when the mechanism is mounted at the bottom of the door.

The door hold and release mechanism of the invention further includes a rectangular cap button 18 which loosely fits over the top open end of the housing 10. The door holding action is initiated by depressing the cap button 18 by hand or foot, for example, thereby compressing a tension spring 20 and forcing an elongated shaft 22 vertically downward through an opening in a shaft guide plate 24. The upper end of the shaft 22 is connected to the cap button 18 by a set screw 26 which passes through the button and is loosely secured to its underneath side by a cap retainer clip 28. The clip 28 allows the set screw 26 to turn independently of the cap button 18. The set screw 26 threads into the upper open end 30 of the shaft 22 and, by turning, varies the tension of the tension spring 20 positioned between the guide plate 24 and the cap button 18.

Figure 3:
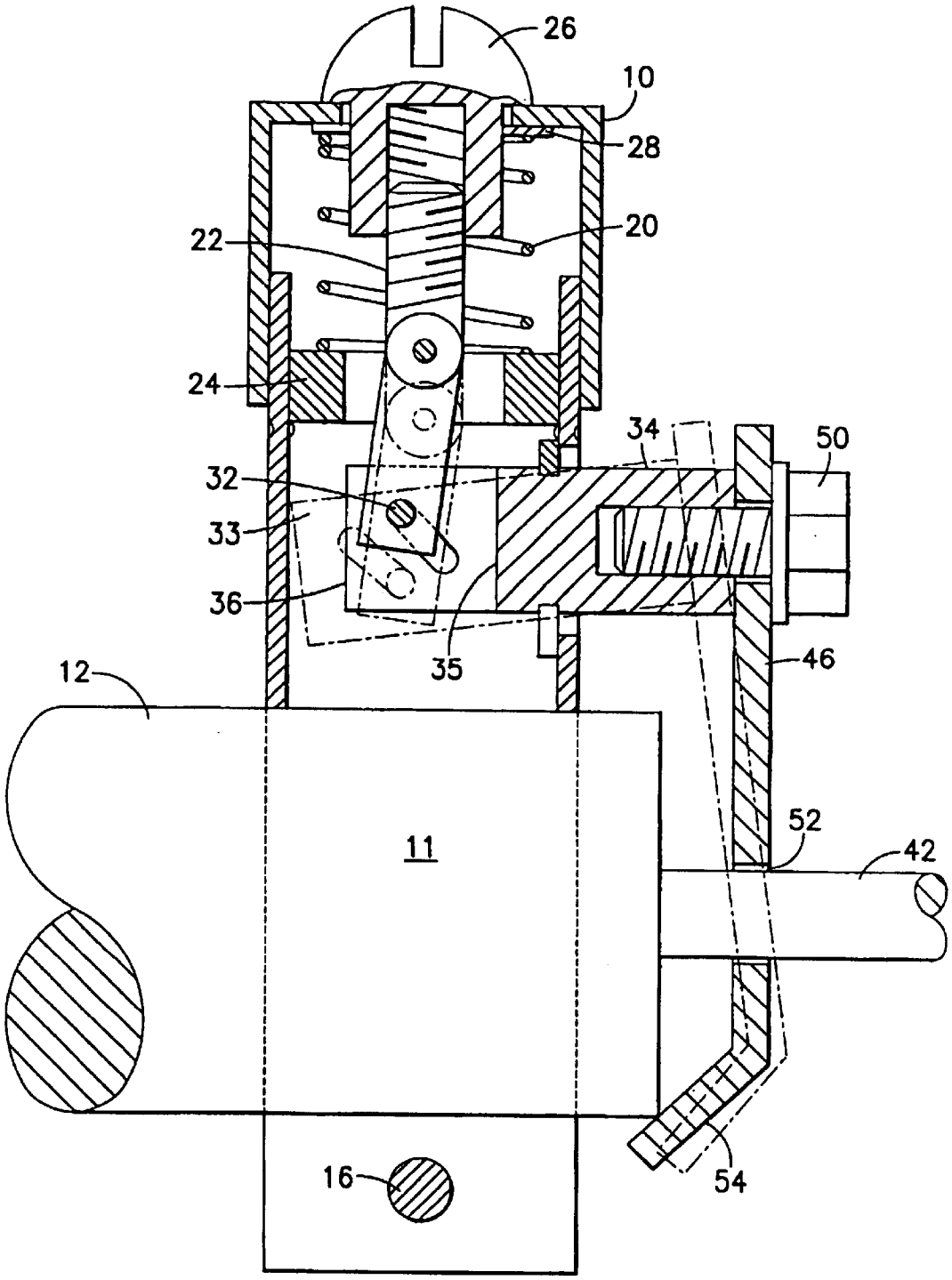
FIG. 3 is a cross-sectional view of the door hold and release mechanism shown in FIGS. 2.

As shown in FIGS. 2 and 3, a cam action linkage assembly is provided for connecting the shaft 22 to a horizontal draw bar 34 within the housing 10. The shaft 22 is formed at its lower end with a narrow flat section 33 which fits loosely inside a narrow opening 35 formed within the rearward end of the draw bar 34. A linkage pin 32 passes through the opening 35 and engages a cam slot 36 formed within the flat section 33. The cam slot 36 extends upwardly and rearwardly at an angle of about 45 degrees, for example, with respect to the longitudinal axis of the shaft 22. As the shaft 22 moves laterally downward upon depression of the cap 18 button, the pin 32 rides to the upper end of the slot 36, drawing the bar 34 in a rearward direction. As the shaft 22 continues to descend, it draws the bar 34 also in a downward direction locking the door in the open position, whereupon it partially returns to its starting location. A snap stop 38 is provided for limiting outward movement of the draw bar 34 as shall be more clearly described hereinafter.

The forward end of the draw bar 34 has a threaded opening 40 and extends outwardly through an exit hole 44 in the side wall of the housing 10. A drop stop 46 is slidably mounted onto the reciprocating piston rod 42 of the pneumatic cylinder 12. The drop stop 46 is secured to the forward end of the draw bar 34 by a bolt 50 and washer 56, the bolt passing through a hole 48 in the drop stop 46 and engaging the threaded opening 40 on the draw bar 34.

The piston rod 42 extends through a hole 52 in the lower end of the drop stop 46. The hole 52 is drilled slightly larger than the diameter of the piston rod 42 and is so designed as to slip over the end of the piston rod 42 when detached from its mounting hardware. The drop stop 46 extends from just above draw bar 34 to a point substantially even with the bottom edge or rim of the pneumatic cylinder 12 as best shown in FIG. 1. The lower end of the drop stop 46 is shaped to have a bend 54 of approximately 30 degrees from the vertical toward the bottom edge of the cylinder 12, beginning from a point just below the hole 52 for the piston rod 42.

When the door hold and release mechanism is in an inactive position as shown by the full lines in FIG. 3, the tension spring 20 forces the cap button 18 and attached shaft 22 to their uppermost positions at the top of the housing 10. The pin 32 rests in the lower end of the cam slot 36, which also is at its uppermost position, and the snap stop 38 is placed in contact with the interior wall of the housing 10, preventing any forward motion of the draw bar 34 beyond the exit hole 44. In this position, the drop stop 46 is perpendicular to the piston rod 42 and is free to slide along its length.

To hold the door open, the cap button 18 is momentarily depressed forcing the shaft 22 vertically downward guided by the shaft guide 24. The cam slot 36 is slanted forward and exerts a rearward and downward pressure on the pin 32, drawing both the draw bar 34 and drop stop 46 into a rearward slanting position as shown by the phantom lines in FIG. 3. This action exerts a friction force between the hole 52 on the drop stop and the piston rod 42. The friction force is significantly increased by the action of the cylinder 12 applying pressure against the angled tip of the drop stop bend 54. The combined pressures hold the door in the open position.

The cap button 18 when released, partially returns to its starting position by the expansion of the tension spring 20 and the free travel distance in the cam slot 36. The remaining tension on the tension spring 20 is adjusted so as not to allow a release of the door unless the weight of the door is removed from the pneumatic cylinder 12. An outward motion of the door subsequently releases this tension and the friction hold of the drop stop 46 on the piston rod 42. The tension spring 20 fully expands and returns the cap button 18 and all connecting parts to their starting positions.

When the door is held in the open position, the set screw 26 is adjusted to a point slightly less than required for a full release of the door from the friction hold by the hole 52 on the drop stop 46. The tension on the tension spring 20 is variable and is dependent on several factors, namely, the weight of the door, the return capacity of the door-closer and the wear on both the hole 52 and the piston rod 42.

The door hold and release mechanism of the invention is effortlessly operated, eliminating many of the problems inherent with the prior art. When a person passing through a door is carrying packages, or perhaps an infant, and the sudden closing of the door might otherwise cause serious harm, one simply has to hold open the door with one hand and depress the cap button 18 with the foot, or if the hold and release mechanism is mounted near the center of the door, with the forearm or elbow and then pass through the door. Upon leaving the person only has to pull or nudge the door outward with the hand, knee or shoulder and the door will very conveniently close behind him. If necessary, the door can be left in the open position when repeated trips through the doorway must be made and later closed by applying an outward pressure on the door.

The simple hold and release actions of a door closer equipped with the instant mechanism are far superior and less complicated than operation of the prior art devices. The use of lock-tabs supplied with prior door checks is inconvenient and requires the tab to be hand located on the piston rod to hold the door open and relocated to its former position behind a crimped portion on the piston rod to allow the door to fully close. This requires a person to hold the door open with one hand and to manipulate the tab with the other hand.

Although the door hold and release mechanism of the invention has been described herein mainly as an add-on feature to new or installed door checks, it is of course entirely possible to employ the device as an integral part of a door check's original design and manufacture.

What is claimed is:

1. A door hold and release mechanism for use with a door closer including a pneumatic cylinder having a reciprocating piston rod, comprising, in combination:

a housing mounted onto said pneumatic cylinder;

a shaft inside said housing, said shaft having first and second ends;

means for applying a bias pressure on said shaft;

a cap button mounted to an end of said housing for applying an external force to said shaft sufficient to move said shaft laterally in a direction opposite to said bias pressure;

a drop stop, said drop stop having a hole through which said piston rod extends, said hole being of such size as to allow movement of said piston rod through said hole in a first position with said drop stop disposed substantially perpendicular to said piston rod but which restricts movement of said piston rod in a second position when said drop stop is tilted at an angle other than substantially perpendicular to said piston rod;

a draw bar having a forward and a rearward end, said forward end of said draw bar being connected to said drop stop for moving said drop stop alternately between said first and second positions; and linkage means associated with said second end of said shaft and cooperating with said rearward end of said draw bar to force said draw bar to move laterally along with said shaft and in a rearward direction in response to said lateral movement of said means for applying an external force, thereby causing said drop stop to tilt from said first to said second position on said piston rod.

2. A door hold and release mechanism according to claim 1, further including means for attaching said first end of said shaft to said cap button.

3. A door hold and release mechanism according to claim 2, wherein said attaching means includes a tension screw passing through said cap button and threaded over said first end of said shaft.

4. A door hold and release mechanism according to claim 2, wherein said means for applying a bias pressure on said shaft comprises a spring mounted in contact with said cap button.

5. A door hold and release mechanism according to claim 4, further including a guide plate having a hole therein for passage of said shaft, said spring being mounted in contact between said guide plate and said cap button.

6. A door hold and release mechanism according to claim 4, wherein said linkage means comprises an elongated cam slot formed in one of said second end of said shaft and said rearward end of said draw bar and a pin extending through said slot and the other of said second end of said shaft and said rearward end of said draw bar, said slot being inclined at an angle with respect to said draw bar such that said draw bar is forced to move rearwardly and simultaneously in a direction opposite said cap button when said external force is applied to said button.

7. A door hold and release mechanism according to claim 6, wherein said angle of said slot is approximately 45 degrees with respect to said draw bar.

8. A door hold and release mechanism for use with a door closer including a pneumatic cylinder having a reciprocating piston rod comprising, in combination:

a housing having an open end;

means for mounting said housing onto said pneumatic cylinder;

a drop stop having a hole through which said piston rod extends, said hole being of such size as to allow movement of said piston rod through said hole in a first position with said drop stop disposed substantially perpendicular to said piston rod but which restricts movement of said piston rod in a second position when said drop stop is tilted at an angle other than substantially perpendicular to said piston rod;

a cap button mounted to said open end of said housing;

a shaft disposed in said housing, said shaft having first and second ends, said first end of said shaft being affixed to said cap button;

a guide plate mounted inside said housing, said guide plate having an opening for guiding said shaft through said housing:

a spring mounted between said guide plate and said cap button, said spring exerting a bias pressure on said shaft in a direction opposite to an external force applied to said cap button;

a draw bar disposed in said housing, said draw bar having a forward and a rearward end, said forward end of said draw bar extending outwardly through said housing and being connected to said drop stop for moving said drop stop alternately between said first and second positions; and linkage means comprising an elongated cam slot formed within said second end of said shaft and a pin extending through said slot and said rearward end of said draw bar, said slot being inclined at an angle with respect to said draw bar such that said draw bar is forced to move both laterally along with said shaft and in a rearward direction in response to said external force applied to said cap button, thereby causing said drop stop to tilt from said first to said second position on said piston rod.

9. A door hold and release mechanism according to claim 8, wherein said angle of said slot is approximately 45 degrees with respect to said draw bar.

10. A door hold and release mechanism for use with a door closer including a pneumatic cylinder having a reciprocating piston rod, comprising, in combination:

a shaft having first and second ends;

means for applying a bias pressure on said shaft;

means for applying an external force to said shaft sufficient to move said shaft laterally in a direction opposite to said bias pressure;

a drop stop, said drop stop having a hole through which said piston rod extends, said hole being of such size as to allow movement of said piston rod through said hole in a first position with said drop stop disposed substantially perpendicular to said piston rod but which restricts movement of said piston rod in a second position when said drop stop is tilted at an angle other than substantially perpendicular to said piston rod;

a draw bar having a forward and a rearward end, said forward end of said draw bar being connected to said drop stop for moving said drop stop alternately between said first and second positions; and linkage means comprising an elongated cam slot formed in one of said second end of said shaft and said rearward end of said draw bar and a pin extending through said slot and the other of said second end of said shaft and said rearward end of said draw bar, said slot being inclined at an angle with respect to said draw bar such that said draw bar is forced to move rearwardly and simultaneously in a direction opposite to that of said means for applying an external force, thereby causing said drop stop to tilt from said first to said second position on said piston rod.

11. A door hold and release mechanism according to claim 10, further including a housing mounted onto said pneumatic cylinder.

12. A door hold and release mechanism according to claim 11, wherein said means for applying an external force to said shaft comprises a cap button mounted to an end of said housing.

13. A door hold and release mechanism according to claim 12, wherein said means for applying a bias pressure on said shaft comprises a spring mounted in contact with said cap button.

14. A door hold and release mechanism according to claim 13, further including a guide plate having a hole therein for passage of said shaft, said spring being mounted in contact between said guide plate and said cap button.

15. A door hold and release mechanism according to claim 12, further including means for attaching said first end of said shaft to said cap button.

16. A door hold and release mechanism according to claim 15, wherein said attaching means includes a tension screw passing through said cap button and threaded over said first end of said shaft.

* * * * *